US010070709B1

(12) United States Patent
Polins et al.

(10) Patent No.: US 10,070,709 B1
(45) Date of Patent: Sep. 11, 2018

(54) BRIEFCASE WITH INTERCHANGEABLE PANELS

(71) Applicant: 2Case, LLC, Tampa, FL (US)

(72) Inventors: Eric R Polins, Tampa, FL (US); Carl Masters, Lawrence, KS (US)

(73) Assignee: 2CASE, LLC, Tampa, FL (US)

( * ) Notice: Subject to any disclaimer, the term of this patent is extended or adjusted under 35 U.S.C. 154(b) by 0 days.

(21) Appl. No.: 15/619,588

(22) Filed: Jun. 12, 2017

(51) Int. Cl.

| | |
|---|---|
| ***A45C 3/02*** | (2006.01) |
| ***A45C 13/02*** | (2006.01) |
| ***A45C 13/08*** | (2006.01) |
| ***B25H 3/02*** | (2006.01) |
| *B65D 73/00* | (2006.01) |
| *A45C 3/00* | (2006.01) |

(52) U.S. Cl.
CPC ..... *A45C 13/02* (2013.01); *A45C 3/02* (2013.01); *A45C 13/08* (2013.01); *B25H 3/023* (2013.01); *A45C 3/00* (2013.01); *B65D 73/00* (2013.01)

(58) Field of Classification Search
CPC ..... A45C 12/02; A45C 13/04; A45C 3/02
USPC ..... 190/109, 110, 112, 900; 150/105
See application file for complete search history.

(56) References Cited

U.S. PATENT DOCUMENTS

| | | | | |
|---|---|---|---|---|
| 767,898 | A | 8/1904 | Lamphier | |
| 1,491,807 | A | 4/1924 | McLinn | |
| 1,689,416 | A | 10/1928 | Wood | |
| 1,994,746 | A | 3/1935 | Banner | |
| 2,016,551 | A | 10/1935 | Landis | |
| 2,493,182 | A | 1/1950 | Beder | |
| 2,555,718 | A | 6/1951 | Hirsch Vineberg | |
| 2,562,499 | A * | 7/1951 | Lifton | A45C 3/02 190/111 |
| 2,585,745 | A * | 2/1952 | Crosby | A45C 3/00 190/109 |
| 3,575,226 | A | 4/1971 | Chapman | |
| 3,777,418 | A | 11/1973 | Cooper | |
| 3,833,098 | A | 9/1974 | Alderman | |
| 4,524,867 | A | 6/1985 | Klein | |
| 4,693,346 | A * | 9/1987 | Eversdijk | A45C 5/03 190/111 |
| 5,350,045 | A * | 9/1994 | Robertson | A45C 13/02 150/111 |
| 5,396,999 | A | 3/1995 | Sandheinrich | |
| 5,653,337 | A | 8/1997 | Cirigliano | |
| 5,671,830 | A * | 9/1997 | Wood | A45C 13/02 150/101 |
| 5,758,751 | A | 6/1998 | Charles | |
| 5,881,850 | A | 3/1999 | Murdoch | |
| 6,173,837 | B1 | 1/2001 | Marconi | |
| 6,805,225 | B2 * | 10/2004 | Freedman | D06F 95/002 190/112 |
| 7,240,778 | B2 | 7/2007 | Duncanson | |
| 7,762,294 | B2 | 7/2010 | Wang | |
| 8,225,934 | B1 | 7/2012 | Malcolm | |

(Continued)

FOREIGN PATENT DOCUMENTS

| | | |
|---|---|---|
| WO | 03055346 | 7/2003 |

*Primary Examiner* — Sue A Weaver
(74) *Attorney, Agent, or Firm* — Maxey-Fisher, PLLC; Stephen Lewellyn

(57) ABSTRACT

A briefcase has a body with a unitary, open frame construction having an interior space and panels that removably attach to body to complete the exterior of the briefcase. The panels provide a selective decorative appearance to the briefcase and may also provide functional elements to the briefcase.

11 Claims, 7 Drawing Sheets

(56) References Cited

U.S. PATENT DOCUMENTS

| | | | | |
|---|---|---|---|---|
| 8,365,886 | B2 | 2/2013 | Mehta | |
| 8,720,718 | B2 | 5/2014 | Myers et al. | |
| 2004/0003975 | A1* | 1/2004 | Dulin | A45C 3/00 190/110 |
| 2006/0037826 | A1 | 2/2006 | Duncanson | |
| 2006/0070901 | A1* | 4/2006 | Adams | B25H 3/00 206/373 |
| 2007/0108005 | A1 | 5/2007 | Augenstein | |
| 2007/0137959 | A1 | 6/2007 | Zauderer | |
| 2008/0087360 | A1 | 4/2008 | Duke | |
| 2009/0196536 | A1* | 8/2009 | Young | A45C 13/02 383/106 |
| 2010/0224294 | A1 | 9/2010 | Svenson | |
| 2012/0097495 | A1 | 4/2012 | Moore | |
| 2012/0241059 | A1 | 9/2012 | Wilson | |
| 2013/0306206 | A1 | 11/2013 | Quinnan | |
| 2014/0224608 | A1 | 8/2014 | Tang | |

* cited by examiner

BRIEFCASE WITH INTERCHANGEABLE PANELS

FIELD OF THE INVENTION

The present invention relates generally to briefcases, and more particularly, relating to a briefcase having decorative and/or functional sidewall panels removably attachable to an open frame case body.

BACKGROUND OF THE INVENTION

Handbags, purses, luggage, and other types of cases that have removable, ornamental coverings are known in the art. The coverings allow a user to change or customize the appearance of the bag. In typical designs, the coverings are attached to an existing, exterior surface of the underlying bag to decorate the surface. These designs can result in an undesirable appearance that is caused by readily noticeable seams or gaps between the bag's exterior surface and the covering attached to that surface.

SUMMARY OF THE INVENTION

In view of the foregoing disadvantages inherent in the known types of bags with decorative coverings now present in the prior art, the present invention provides a briefcase with interchangeable panels that reduces or eliminates any undesirable seams or gaps between the panels and the underlying briefcase structure.

Accordingly, one aspect of the invention is a briefcase including a body having a first end wall spaced apart from a second end wall, a top wall spaced apart from a bottom wall, and a first side wall spaced apart from a second side wall, the walls defining an interior space of the body; the case body defining a first opening formed through the first side wall and through which the interior space is accessible and a second opening formed through the second side wall and through which the interior space is accessible; a door panel hingedly connected to the body and positionable between a first position wherein the door panel covers the first opening and a second position wherein the door panel does not cover the first opening; first panel removably attached to the door panel and covering an exterior surface of the door panel when attached to the door panel; and a second panel removably attached to the body and covering the second opening when attached to the body.

The first panel may have opposite first and second faces, and wherein the opposite first and second faces of the first panel have a different decorative appearance. And the second panel may opposite first and second faces, and wherein the opposite first and second faces of the second panel having a different decorative appearance.

In other aspects, the panels could also be provided with functional elements. For example, one or both panels maybe provided with solar panels that are operable to provide power to a USB port, for example, to allow a user to plug a device into the USB port for battery charging. Numerous other possibility also exists to provide the panels with functional aspects.

There has thus been outlined, rather broadly, some features of the invention in order that the detailed description thereof that follows may be better understood and in order that the present contribution to the art may be better appreciated.

Numerous objects, features and advantages of the present invention will be clear to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in many ways. Also, it is to be understood that the phraseology and terminology employed herein are for descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
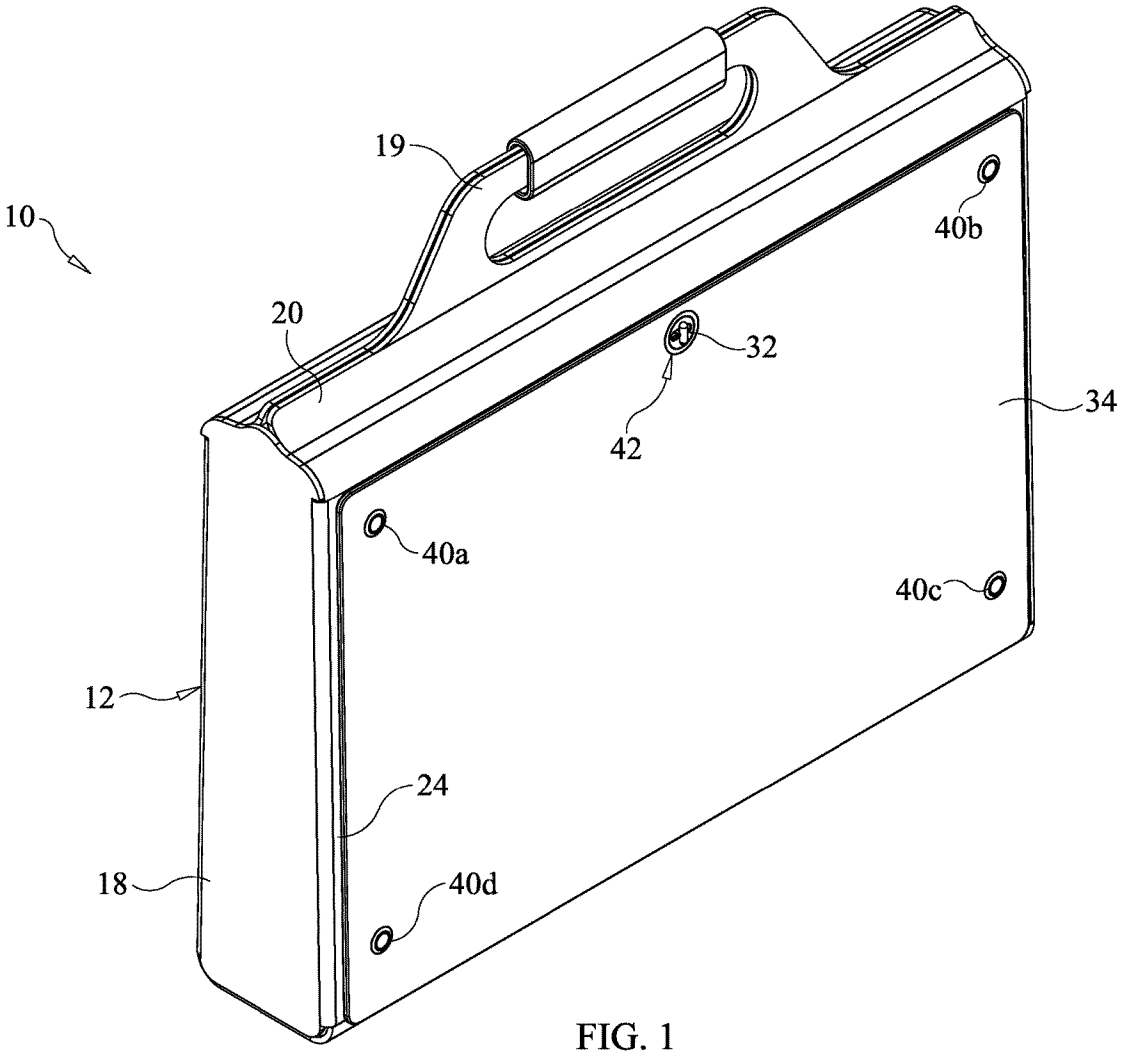
FIG. 1 is a perspective view of a briefcase constructed in accordance with the principles of an embodiment of the present invention.

Initially referring to FIGS. 1-4, representatively illustrated therein is a briefcase 10 that is constructed in accordance with an embodiment of the present invention. The briefcase 10 comprises a case body 12 that is constructed of a rigid material, such as, metal, plastic, or combinations thereof, for example.

The case body 12 comprises a plurality of connected walls that create an open frame structure having an interior space 14. Particularly, in the illustrated embodiment, the case body 12 comprises a first end wall 16 spaced apart from a second end wall 18, a top wall 20 spaced apart from a bottom wall 22, and a first side wall 24 spaced apart from a second side wall 26. The interior space 14, bounded by walls 16-26, is accessible through openings 28 and 29 formed through the first side wall 24 and the second side wall 26, respectively. The case body 12 further comprises a handle 19 that is connected to and extends in a direction upwardly from the top wall 20. The handle 19 can be formed to be integral with the top wall 20.

In the illustrated embodiment, the case body 12 departs from conventional briefcase designs because of its unitary, open frame construction. Whereas, conventional briefcase designs are based upon a clamshell type construction comprising two half-portions that are hingedly connected and rotate away and toward from one another to open and close the briefcase.

With continued reference to FIGS. 1-4, the briefcase 10 further comprises a door panel 30 that is hingedly connected to the case body 12 to rotate in a direction toward and away from the first side wall 24 of the case body between a closed, first position wherein the door panel closes opening 28 and an open, second position wherein the door panel is disposed away from the opening, through which and the interior space is accessed.

The door panel 30 maybe secured in the closed, first position by a latch that prevents the door panel from moving away from the case body 12 and into the second position. As a nonlimiting example, the latch 32 is representatively shown as a turn-button type fastener that is attached to the case body 12 and extends through a slot formed through the door panel 30 when the door panel is in the first position.

Figure 2:
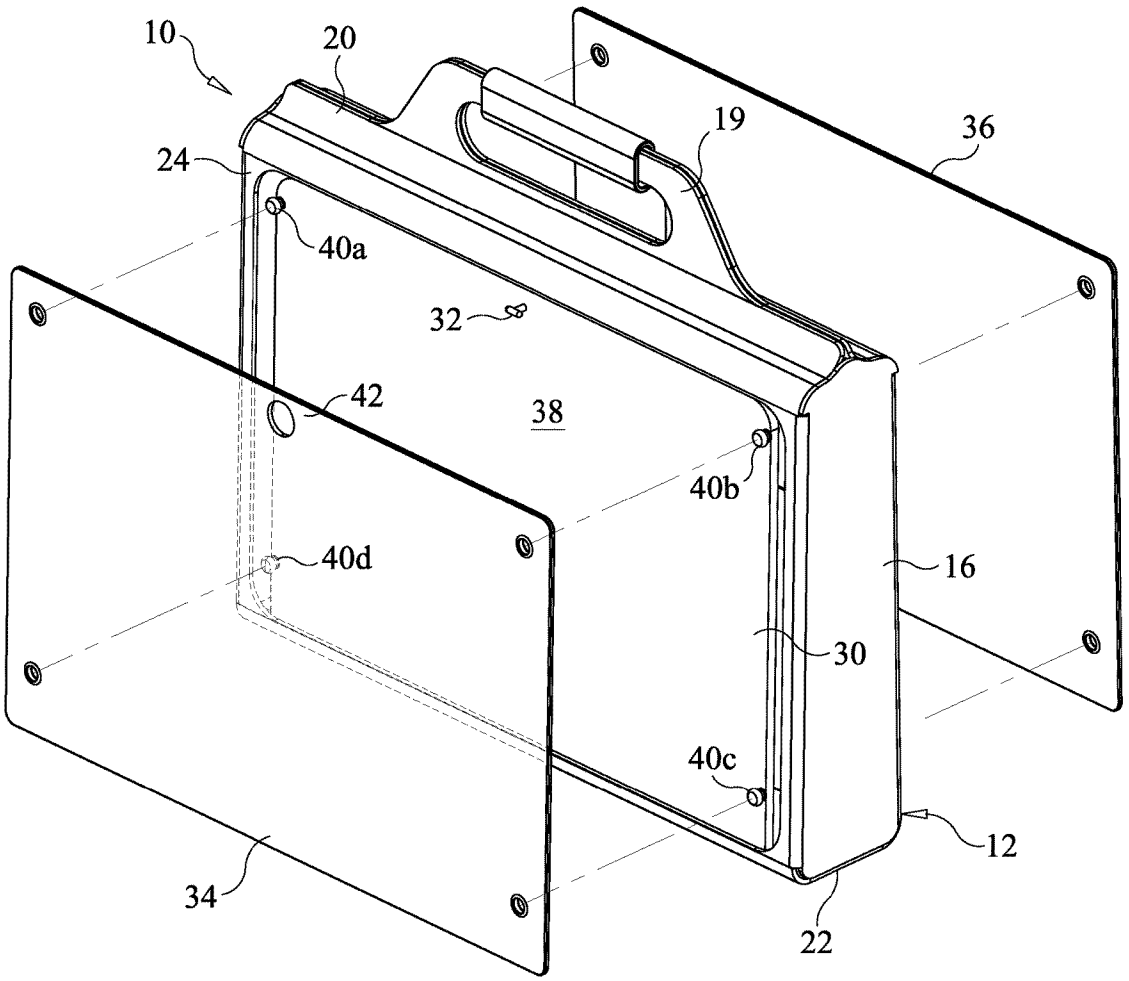
FIG. 2 is a first side perspective view of the briefcase, showing a pair of panels exploded from the briefcase.
Figure 3:
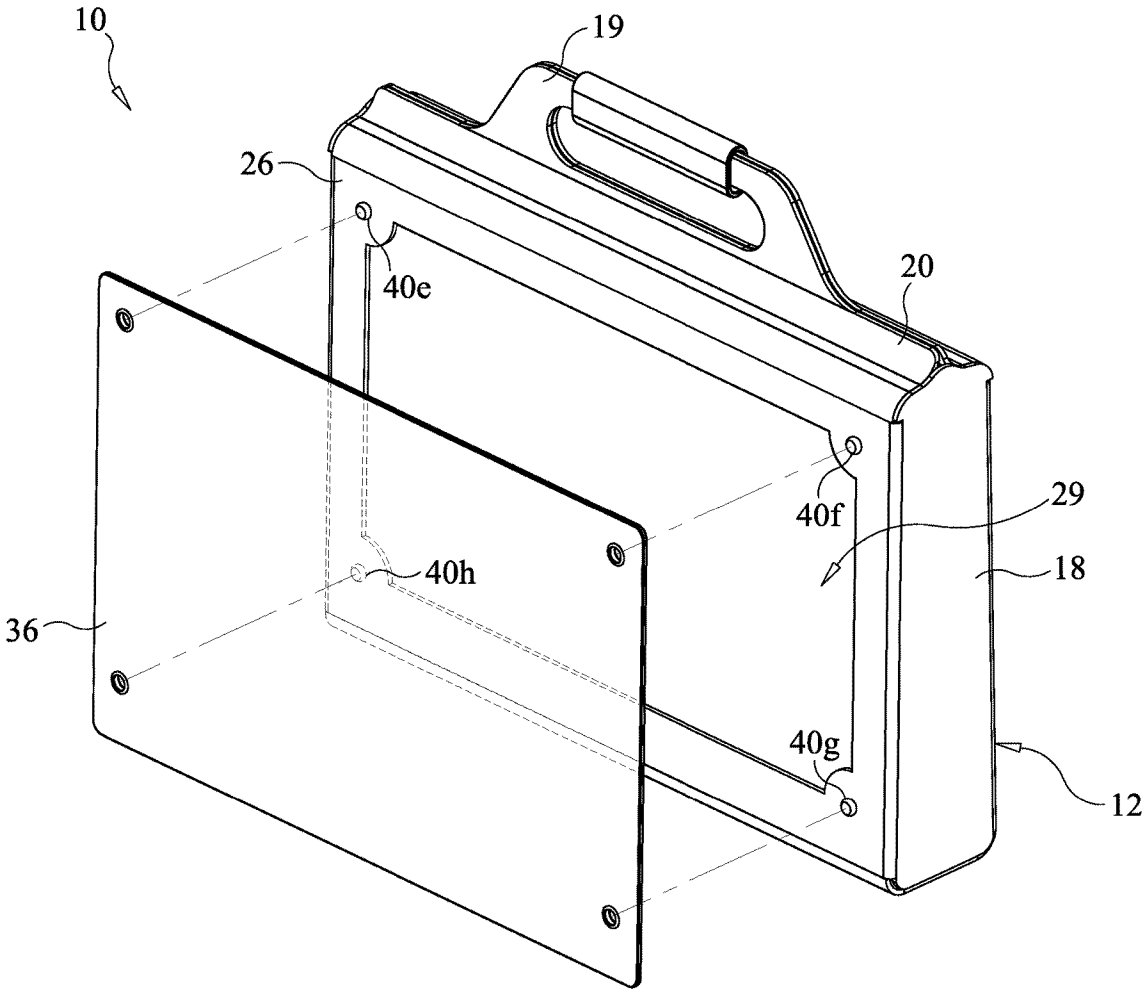
FIG. 3 is a second side perspective view of the briefcase, showing a panel exploded from the briefcase.
Figure 4:
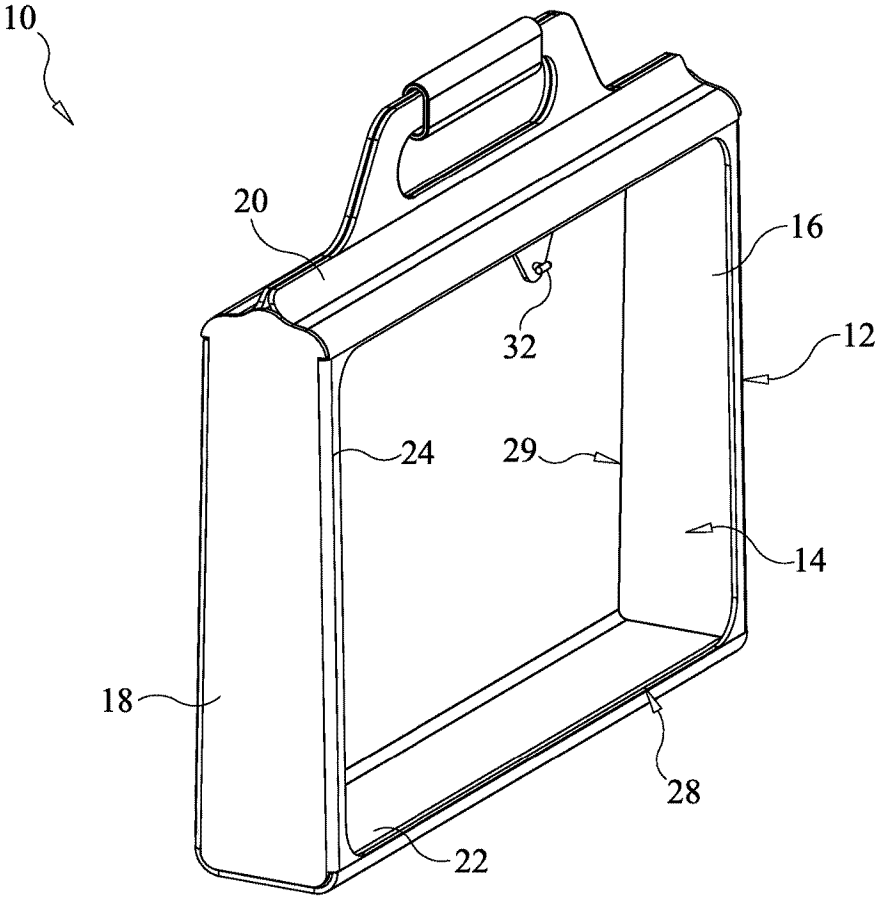
FIG. 4 is a perspective view of the briefcase, showing a case body with an open frame construction.

Referring to FIGS. 1-3, the briefcase 10 further comprises a pair of panels 34 and 36 that are removably attachable to the case body 12. In the illustrated embodiment, panel 34 is removably attached to the door panel 30 and is sized to substantially cover the exterior surface 38 of the door panel. Panel 34 may be removably attached to the door panel 30 by one or more cooperating fasteners. For example, as depicted, panel 34 is attached to the door panel 30 by a plurality of fasteners 40*a*-40*d* that are disposed around the perimeter of the door panel and engage with panel 34 to secure the panel to the door panel. Additionally, as shown, panel 34 includes an aperture 42 formed therethrough through which latch 32 is accessibly when the panel is attached to the door panel 34.

Similarly, panel 36 is removably attachable to the case body 12 and is sized to substantially cover the exterior surface of the second side wall 26 and close the opening 29 formed through the second side wall. Panel 36 may be removably attached to the case body 12 by one or more cooperating fasteners. For example, as depicted, panel 36 is attached to the case body 12 by a plurality of fasteners 40*e*-40*h* that are disposed around the perimeter of the second side wall 26 and engage with panel 36 to secure the panel to the case body.

As illustrated, each fastener 40*a*-40*h* comprises a peg that is removably received by a corresponding grommet disposed on or through panel 34 or 36. However, it is to be appreciated that other types of fasteners may be used to removably attach and retain panels 34 and 36 to the door panel 30 and case body 12, respectively.

In one aspect, the panels 34 and 36 are ornamental and provide a decorative appearance to the briefcase 10. The surfaces of panels 34 and 36 may be provided with any number of designs, patterns, textures, colors, etc. for a user to customize the appearance of the briefcase 10 to his or her individual desires. As a nonlimiting example, one surface of each panel 34 and 36 may be provided with a brown leather appearance, while the opposite surface of each panel 34 and 36 may be provided with a black leather appearance. In this example, a user may attach panels 34 and 36 so that the black leather surfaces are faced outwardly, thereby providing the briefcase 10 with a corresponding black leather appearance. Alternatively, the user may attach panels 34 and 36 so that the brown leather surfaces are faced outwardly, thereby providing the briefcase 10 with a corresponding brown leather appearance.

Figure 5:
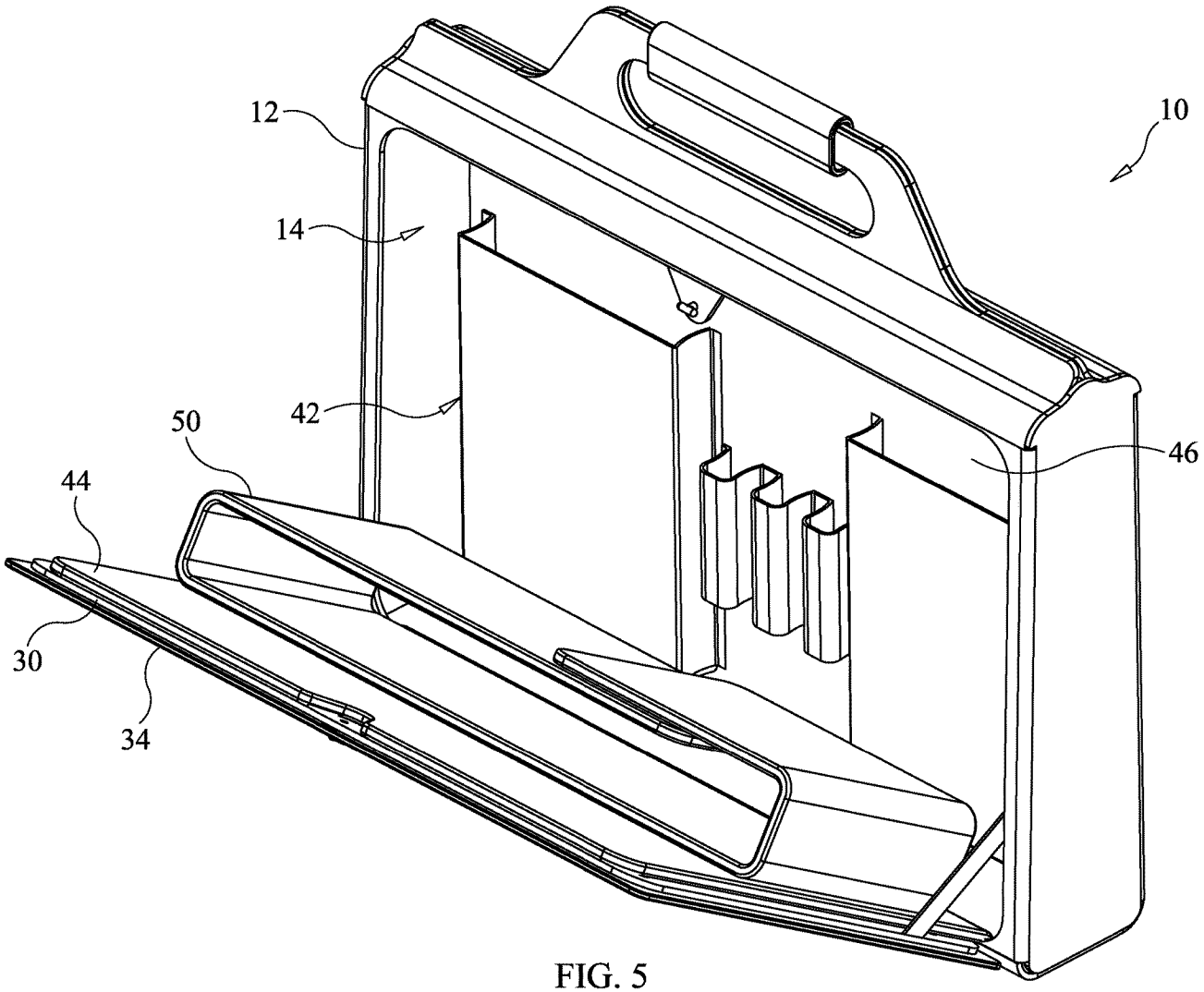
FIG. 5 is a perspective view of the briefcase, showing the briefcase open and illustrating an insert assembly located within the briefcase.
Figure 6:
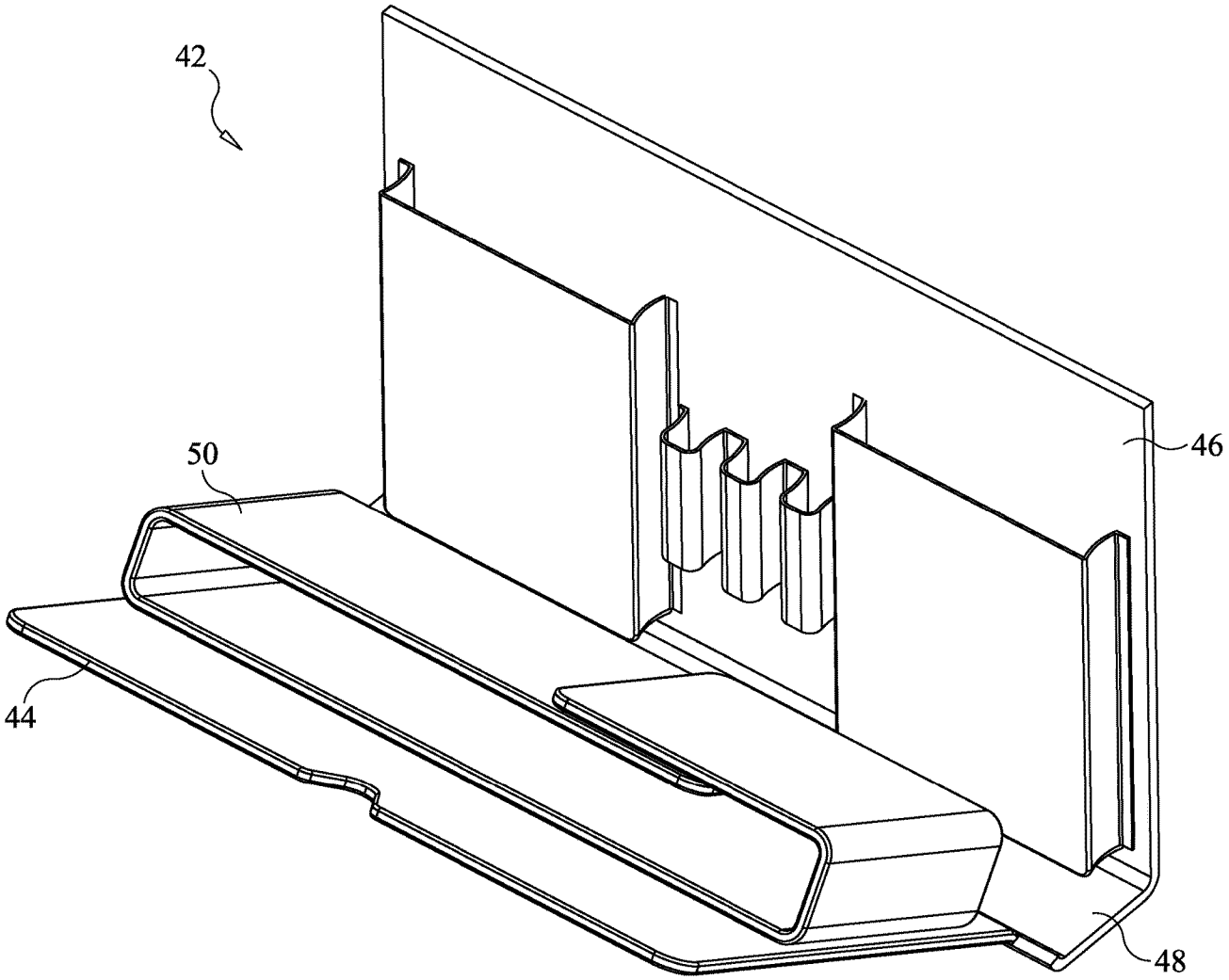
FIG. 6 is a perspective view of the insert assembly removed from the briefcase.
Figure 7:
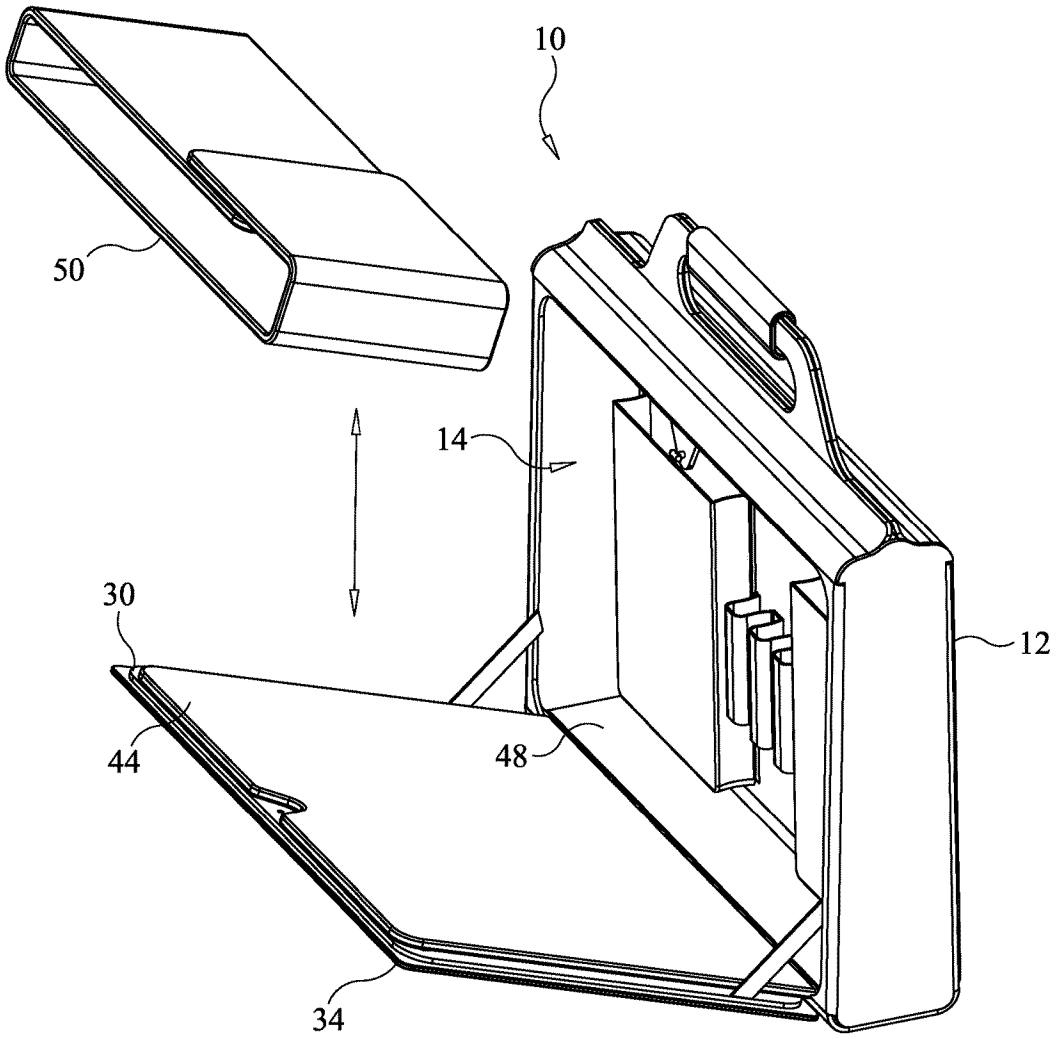
FIG. 7 is a perspective view of the briefcase, showing the briefcase open and illustrating the insert assembly located within the briefcase and with a sleeve detached from the insert assembly.

Referring now to FIGS. 5-7, the briefcase 10 may further comprise an insert assembly 42 that is removably disposed within the interior space 14 of the case body 12. The insert assembly 42 may comprise any number of configurations of pockets and sleeves to organize items that a user may want to carry within the briefcase 10.

As depicted, the insert assembly 42 comprises first and second leaf panels 44 and 46 that are hingedly connected by a spine panel 48. The first leaf panel 44 may be removably attached to the interior surface of the door panel 30 for conjoined movement with the door panel when the door panel is moved between the closed, first position and the open, second position. The second leaf panel 44 may be removably attached to an interior surface of the second side wall. The leaf panels 44 and 46 may be attached, respectively, by any suitable fasteners, including magnetic fasteners, touch fasteners, snaps, buttons, etc., for example. Additionally, the insert assembly 42 may include a sleeve 50 that is attached to the first leaf panel 44. The sleeve 50, may be sized to hold a portable electronic device, such as a laptop, tablet, or the like. In an aspect, the sleeve 50 may be removably attached to the first leaf panel by any suitable fastener.

Several embodiments of the present invention have been described. Nevertheless, it will be understood that various modifications may be made without departing from the spirit and scope of the invention. Accordingly, other embodiments are within the scope of the following claims.

What is claimed is:

1. A briefcase comprising:

a case body having a first end wall spaced apart from a second end wall, a top wall spaced apart from a bottom wall, and a first side wall spaced apart from a second side wall, the walls defining an interior space of said body;

said case body defining a first opening formed through said first side wall and through which said interior space is accessible;

said case body defining a second opening formed through said second side wall and through which said interior space is accessible;

a door panel having an exterior surface, said door panel hingedly connected to said body and positionable between a first position wherein said door panel covers said first opening and a second position wherein said door panel does not cover said first opening;

a first panel having a peripheral edge and opposite first and second faces, each of said first and second faces of said first panel bounded by said peripheral edge of said first panel, said first panel removably attached to said door panel with said entire peripheral edge of said first panel free from attachment to said door panel and covering said exterior surface of said door panel;

a second panel having a peripheral edge and opposite first and second surfaces, each of said first and second faces of said second panel bounded by said peripheral edge of said second panel, said second panel removably attached to said body with said entire peripheral edge of said second panel free from attachment to said body and covering said second opening;

wherein said opposite first and second faces of said first panel having a different decorative appearance;

wherein said opposite first and second faces of said second panel having a different decorative appearance.

2. The brief case of claim 1, wherein said first face of said first panel and said first face of said second panel have a same decorative appearance, and wherein said second face of said first panel and said second face of said second panel have the same a same decorative appearance.

3. The briefcase of claim 1, wherein further comprising a latch engageable with said door panel to secure said door panel in said first position.

4. The briefcase of claim 1, further comprising an insert assembly disposed within said interior space.

5. The briefcase of claim 4, wherein said insert assembly includes first and second leaf panels that are hingedly connected by a spine panel.

6. The briefcase of claim 5, wherein said first leaf panel is removably attached to an interior surface of said door panel for conjoined movement therewith, wherein said second leaf panel is removably attached to an interior surface of said second side wall and said spine panel disposed along an interior surface of said bottom wall.

7. The briefcase of claim 5, wherein said insert assembly includes a sleeve connected to said first leaf panel.

8. The briefcase of claim 7, wherein said sleeve is removably attached to said first leaf panel.

9. The briefcase of claim 1, wherein said second opening is formed at an inwardly spaced distance from the perimeter of said second wall thereby defining a wall surface between the perimeter of said second wall and said second opening; and wherein said second panel is removably attached to said body by a plurality of fasteners that disposed on said wall surface and spaced around said second opening.

10. The briefcase of claim 1, wherein said first panel is removably attached to said body by a plurality of fasteners that are disposed on said exterior surface of said door panel.

11. The briefcase of claim 1, further comprising a handle on said top wall.

* * * * *